US011261562B2

(12) United States Patent
Nitschmann et al.

(10) Patent No.: US 11,261,562 B2
(45) Date of Patent: Mar. 1, 2022

(54) CONVEYOR DEVICE FOR A FOLDING APPARATUS FOR FOLDING TEXTILES

(71) Applicant: BSH HAUSGERAETE GMBH, Munich (DE)

(72) Inventors: Kai Nitschmann, Neuenhagen (DE); Martin Schubert, Berlin (DE); Oliver Wuttge, Berlin (DE)

(73) Assignee: BSH Hausgeraete GmbH, Munich (DE)

( * ) Notice: Subject to any disclaimer, the term of this patent is extended or adjusted under 35 U.S.C. 154(b) by 82 days.

(21) Appl. No.: 16/639,826

(22) PCT Filed: Aug. 29, 2018

(86) PCT No.: PCT/EP2018/073221
§ 371 (c)(1),
(2) Date: Feb. 18, 2020

(87) PCT Pub. No.: WO2019/052808
PCT Pub. Date: Mar. 21, 2019

(65) Prior Publication Data

US 2020/0248397 A1 Aug. 6, 2020

(30) Foreign Application Priority Data

Sep. 14, 2017 (DE) ..... 102017216233

(51) Int. Cl.
*D06F 89/02* (2006.01)
*B65H 5/02* (2006.01)
(Continued)

(52) U.S. Cl.
CPC ..... *D06F 89/023* (2013.01); *B65H 5/021* (2013.01); *B65H 5/023* (2013.01); *B65H 29/16* (2013.01);
(Continued)

(58) Field of Classification Search
CPC ..... D06F 89/023; D06F 89/00; D06F 89/02; D06F 67/04; B65H 5/021; B65H 29/16;
(Continued)

(56) References Cited

U.S. PATENT DOCUMENTS 2,464,823 A * 3/1949 Malott, Jr. ..... D06F 89/00 493/444
3,212,771 A 10/1965 Kerman et al.
(Continued)

FOREIGN PATENT DOCUMENTS

EP 1829807 A2 9/2007

OTHER PUBLICATIONS

MHI GmbH on Jan. 9, 2017 on the website http://mhi-maschinenbau.de/emba-service-2/ersatzteile/emba-mini-160-175/richt-and-zaehlstation/unterer-einlauf-und-abtransport/.

*Primary Examiner* — Jeremy R Severson
(74) *Attorney, Agent, or Firm* — Laurence A. Greenberg; Werner H. Stemer; Ralph E. Locher

(57) ABSTRACT

A conveyor device for a folding apparatus for folding textiles includes an infeed region for a textile and an outfeed region for a folded textile. A first belt conveyor conveys the textile on a first conveyor plane from the infeed region to a first transfer unit, which feeds the textile to a second conveyor plane of a second belt conveyor. At least one second transfer unit and at least one additional belt conveyor having an additional conveyor plane are disposed downstream of the belt conveyor. At least two subassemblies, each configured as modular conveyor units are provided, into which one belt conveyor and at least one transfer unit are each integrated. The conveyor device is modularly configured, in that a plurality of modular conveyor units are disposed one atop the other and connected to each other.

6 Claims, 6 Drawing Sheets

(51) Int. Cl.

| | |
|---|---|
| ***B65H 29/16*** | (2006.01) |
| ***B65H 37/06*** | (2006.01) |
| ***B65H 45/14*** | (2006.01) |
| ***D06F 89/00*** | (2006.01) |

(52) U.S. Cl.
CPC ..... *B65H 37/06* (2013.01); *B65H 45/14* (2013.01); *D06F 89/00* (2013.01); *B65H 2402/10* (2013.01); *B65H 2404/2612* (2013.01); *B65H 2404/2615* (2013.01)

(58) Field of Classification Search
CPC .... B65H 2404/2612; B65H 2404/2615; B65H 2402/10
See application file for complete search history.

(56) References Cited

U.S. PATENT DOCUMENTS

| | | | | |
|---|---|---|---|---|
| 3,361,424 | A * | 1/1968 | Kamberg | D06F 89/00 493/423 |
| 3,462,138 | A * | 8/1969 | Grantham | D06F 89/00 493/441 |
| 7,517,308 | B2 | 4/2009 | Stentenbach | |
| 2003/0052141 | A1* | 3/2003 | Rauch | D06F 89/00 223/37 |
| 2019/0309465 | A1* | 10/2019 | Rozov | A41H 43/0257 |

* cited by examiner

CONVEYOR DEVICE FOR A FOLDING APPARATUS FOR FOLDING TEXTILES

BACKGROUND OF THE INVENTION

Field of the Invention

The invention relates to the mechanical treatment, in particular the transportation and folding of textiles, wherein the term "folding" is to be understood broadly and includes the shaping and/or arrangement of textiles and laundry such as, for example, covers, sheets, but also items of clothing, such as, for example, shirts. In particular in commercial cleaning companies and laundries, it is desirable for the cleaned textiles or laundry items to be provided in a neatly arranged form—i.e. for example shirts in an identical and precisely shaped manner.

Automated mechanical treatment of textiles requires conveyor devices for transporting the textiles successively in a folding apparatus to the different individual folding devices (hereinafter also called folding steps or folding layers).

Herein, it is in particular possible to use so-called belt or strap conveying mechanisms, such as those described, for example, by the company MHI GmbH on 1 Sep. 2017 on the website http://mhi-maschinenbau.de/emba-service-2/ersatz-teile/emba-mini-160-175/richt-und-zaehlstation/unterer-einlauf-und-abtransport/ and which comprise belts or bands as transport means (hereinafter generally also called a strap).

A conveyor device design for a folding apparatus, with which, for example, different textiles are subjected to longitudinal and transverse folding in a plurality of folding steps, should be provided with different roller-mounted transport straps, often arranged in different planes, to transport the textiles. In the known conveyor devices mentioned in the introduction, usually, all the bearings of the axes or shafts of the rollers that deflect the transport bands are arranged in side plates located opposite to one another to the side of the transport bands. A significant axial offset can occur with the plurality of individual axes mounted rigidly relative to one another because the individual axis tolerances are added together to form a large tolerance chain. Such a design is still not optimal with respect to an assembly that provides process stability, is optimized with respect to cost and time and also allows advance inspections on the conveyor devices and provides ease of dismantling and repair.

Against this background, it is an object of the present invention to provide conveyor device for a folding apparatus for folding textiles characterized by an assembly that provides process stability and is optimized with respect to cost and time, ease of access for repair work, increased ease of dismantling and allows advance inspections on individual components of the conveyor device.

SUMMARY OF THE INVENTION

This object is achieved according to the invention by a conveyor device with the features of the independent claim. Optional preferred embodiments of the invention are defined in independent claims, described in the following description or depicted in the attached drawing. Such embodiments can, in principle, also be combined with one another in order to form additional preferred embodiments.

Accordingly, the conveyor device according to the invention for a folding apparatus for folding a textile comprises an infeed region for the textile and an outfeed region for the folded textile. A first belt conveyor conveys the textile on a first conveyor plane from the infeed region to a first transfer unit, which feeds the textile to a second conveyor plane of a second belt conveyor. Viewed in the conveying direction of the textile, at least one second transfer unit and then at least one additional belt conveyor having an additional conveyor plane are arranged downstream of the second belt conveyor. At least two subassemblies each embodied as modular conveyor units are provided in which in each case one belt conveyor and in each case at least one transfer unit are integrated. The conveyor device has a modular design in that a plurality of modular conveyor units are arranged one atop the other and are connected to one another.

This enables the conveyor device to transport textiles (for example shirts) in a folding apparatus from each folding step to the next. Herein, the textile in the individual folding steps may be subjected to different folding or shaping processes—in the example of the shirt, for example, feeding to a first folding step for sleeve folding and then widthwise folding and lengthwise folding—before it arrives at the outfeed region where it can be removed, stacked or stored in folded state.

The invention enables the individual conveyor planes to be aligned and positioned very precisely with respect to one another. Herein, the conveyor units can be connected to one another preferably in a detachable manner, for example non-positively and/or positively. This endows the conveyor device with a rigid and stable overall structure without any requirement for the side plates mentioned in the introduction that are disadvantageous for various reasons.

The modular design of the conveyor device according to the invention also has the advantage that the individual modular conveyor units can be positioned and aligned with respect to one another by suitable means (spacer bushings, adjusting screws and the like). This reduces the conveyor device's tolerance chains in respect of the individual axes of the deflecting and driving rollers or the like.

Depending on the nature of the textiles to be transported, the conveyor units or the belt conveyors thereof can comprise one wide transport band and/or a plurality of narrower transport bands.

A further advantage of the invention consists in the fact that the individual modular conveyor units can be preassembled thus enabling the costs and time of assembly to be optimized and process stability to be increased. If maintenance or repair work is required, the conveyor device is simple and easy to dismantle by separating the individual modular conveyor units from one another. A defective conveyor unit can be quickly replaced by a standardized modular conveyor unit held in stock. The modular design also enables standardized design and manufacture of the basic components of the respective conveyor units thus enabling mass production with advantages in respect of costs and manufacturing outlay.

According to a preferred embodiment of the invention from the viewpoint of drive technology, it is provided that a plurality of belt conveyors are driven by at least one common drive strap.

According to an advantageous development of the invention, maintenance (for example if textiles become caught or jammed during transport) and repair of the device according to the invention is facilitated in that the transfer unit of at least one modular conveyor unit is pivotable relative to this conveyor unit from its operating position into a service position.

According to a preferred further development of the invention, reliable conveyance of the textile in the respective transfer region is further improved in that the transfer unit is under spring tension in the operating position.

In this context, it is preferred from a structural point of view for the spring tension to be applied by one or more conveyor straps of the respective conveyor unit.

According to one advantageous embodiment of the invention, the versatility of the conveyor device according to the invention with respect to different textiles to be conveyed is increased in that a gap is set between a transfer unit and a corresponding belt conveyor, whereby said gap widens in dependence on the thickness of a conveyed textile.

BRIEF DESCRIPTION OF THE SEVERAL VIEWS OF THE DRAWING

The invention is explained in more detail below with reference to illustrations of preferred exemplary embodiments. The attached drawing shows.

DESCRIPTION OF THE INVENTION

Figure 1:
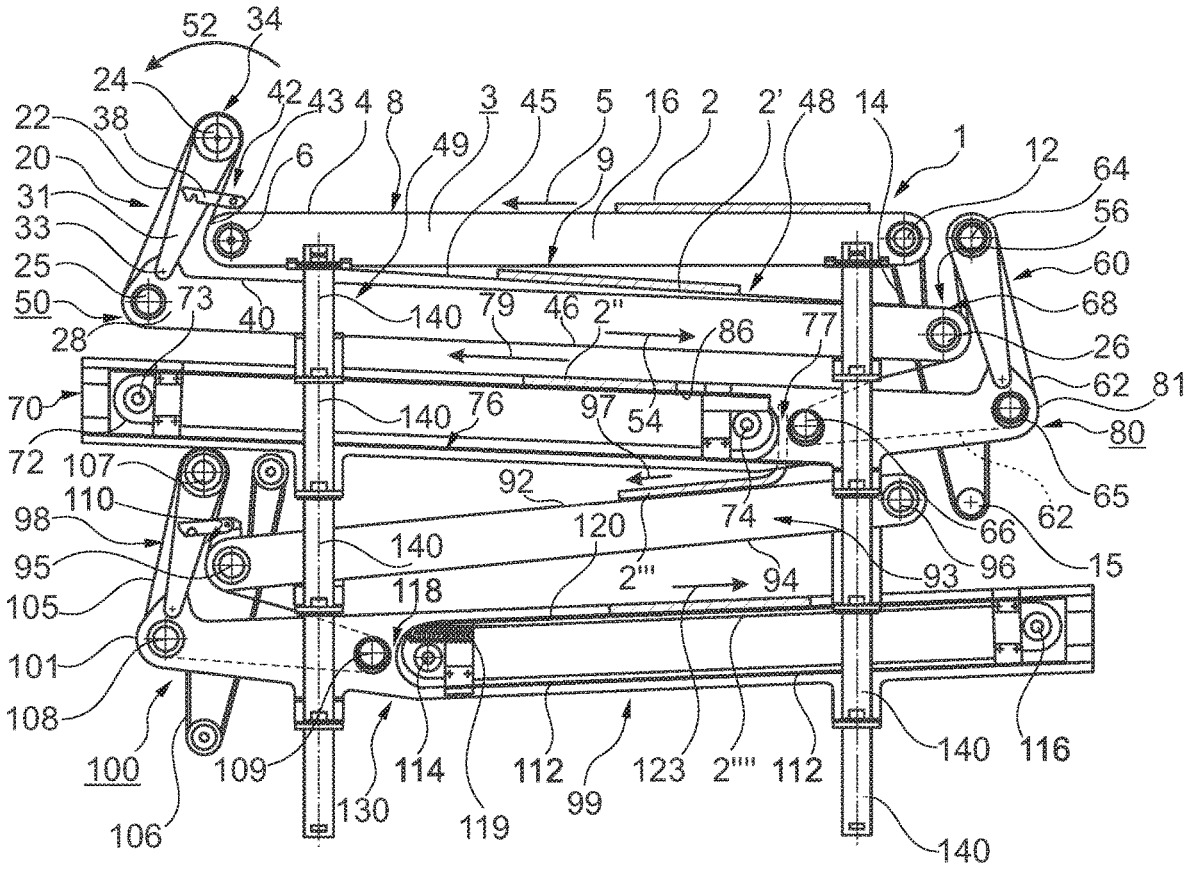
FIG. 1 a schematic side view of a folding apparatus for folding textiles with a conveyor device, FIG. 2 a perspective view of the folding apparatus in FIG. 1, FIG. 3 a side view of a further exemplary embodiment of a conveyor device before assembly, FIG. 4 a side view of the conveyor device in FIG. 3 in assembled state in a maintenance state, FIG. 5 a perspective view of the conveyor device in FIGS. 3 and 4 in operational state and FIG. 6 a side view of the conveyor device in FIG. 5 while transporting a textile.
Figure 2:
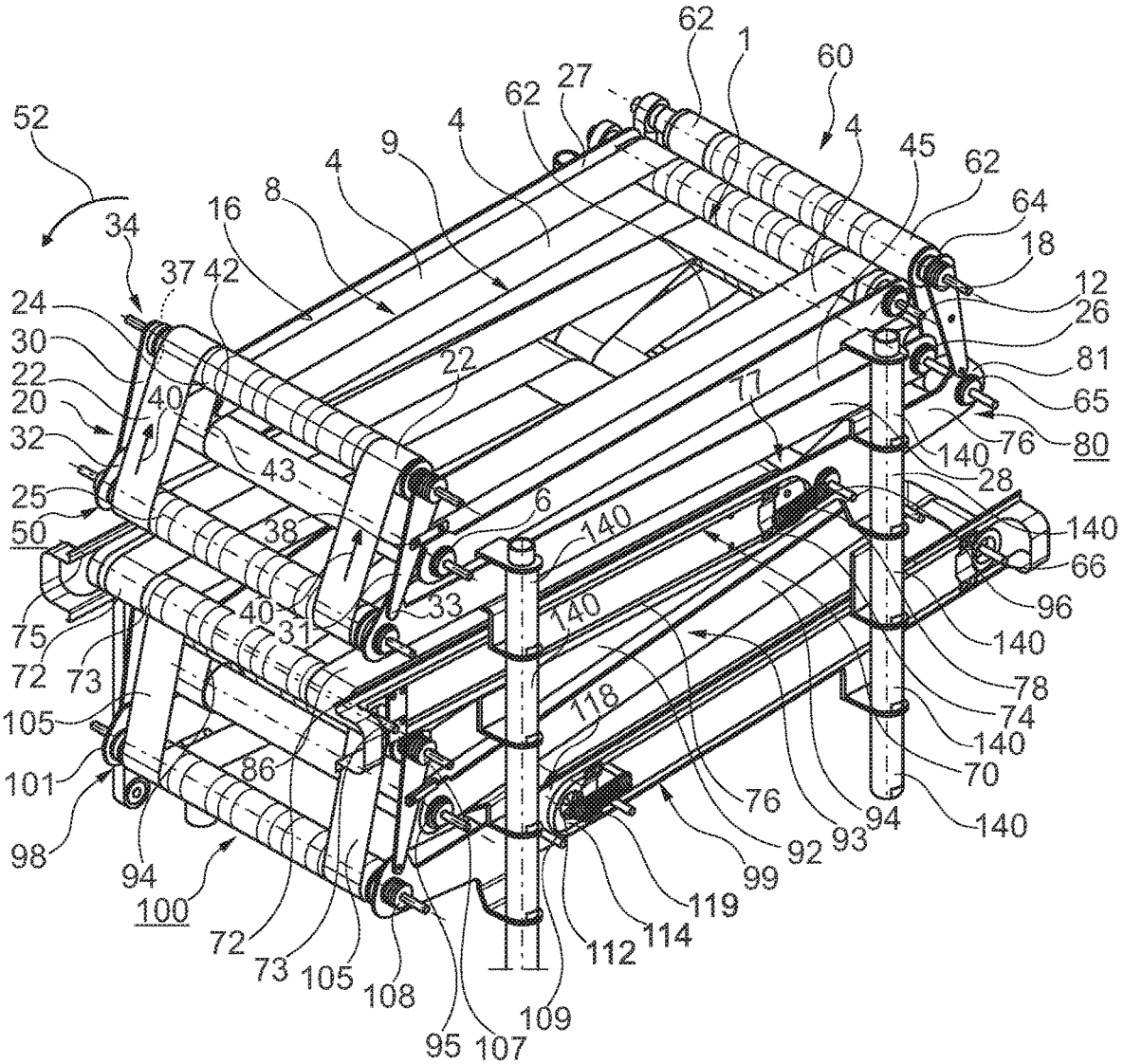

FIGS. 1 and 2 are side and perspective views of a first exemplary embodiment of a conveyor device according to the invention for a folding apparatus for folding textiles. The conveyor device comprises a feed or infeed region 1 for a textile 2 (in FIG. 1 only depicted schematically as a flat laundry item). A first belt conveyor 3 with a conveyor belt or conveyor band (hereinafter generally 'conveyor strap') 4 transports the laundry item 2 in the arrow direction 5. Herein, one single conveyor strap or a plurality of conveyor straps 4 can be provided, which rotates, or rotate, over a deflecting roller 6 and returns, or return, below a first conveyor plane 8 formed by the upper sides of the straps 4 in an approximately parallel plane 9 and is, or are, deflected around a driven deflecting roller (driving roller) 12. A drive of the driving roller 12 over a drive strap 14 is indicated schematically by a drive 15 of a drive motor that is not shown in greater detail. Herein, the deflecting rollers 6, 12 are mounted in two opposite side parts 16, 18.

The belt conveyor 3 further conveys the laundry item 2 in the arrow direction 5 to a first transfer unit 20. The transfer unit has clamped conveyor straps 22, which rotate over a first deflecting roller 24 and an additional deflecting roller 25 to a driving roller 26. The rollers 25, 26 are mounted with each of their ends in a side plate 27, 28. A pivotable lever 30, 31 that can be pivoted about a pivot axis formed by two pivot points 32, 33 and in its operating position 34 shown in FIGS. 1 and 2 is in each case fixed by interlocking elements 37, 38 engaging behind pins is coupled to each side plate 27, 28.

The straps 22 wrap round a partial circumference of the straps 4 of the first belt conveyor 3 running over the deflecting roller 6. Viewed in the drive direction 40 of the straps 22, the straps 22 are released again when the region of the deflecting roller 6 is exited. On the input side, in the region 42, they form an initially tapering minimum gap 43 with the straps 4. The straps 4 then run as far as the driving roller 26 and their upper sides form a second conveyor plane 45 for textiles. Below this, the straps run in a plane 46 to the deflecting roller 25. Thus, a second belt conveyor 48 is formed. Together with the transfer unit 20, as an integral component and firmly connected thereto, this forms a first subassembly 49. This subassembly 49 is self-contained and constitutes a first modular conveyor unit 50, which can be assembled in advance and tested.

Herein, the transfer unit 20 can slightly spring back around the pivot points 32, 33 if a laundry item with a thickness greater than the minimum gap 43 formed between the belts 22 and the belts 4 enters this minimum gap. In order to make the region between the first belt conveyor 3 and the second belt conveyor 48, laterally from the left, and the conveyor plane 45 accessible, the interlocking elements 37, 38 are unlocked so that the transfer unit 20 can be swung open counterclockwise in the arrow direction 52.

For better understanding, in FIG. 1 the further-transported laundry item 2 on the second conveyor plane 45 is indicated after it has between transferred from the first belt conveyor 3 over the transfer unit 20 to the second belt conveyor 48 and further transported on the conveyor plane 45 in the arrow direction 54 (for example to a first folding step that is not shown in further detail). In this position, the laundry item is designated 2' for differentiation.

On additional transport in the arrow direction 54, the laundry item 2' enters the drawing-in region 56 of a second transfer unit 60. This has substantially the same design as the transfer unit 20. A plurality of straps 62 run over an upper deflecting roller 64, a lower deflecting roller 65 embodied as a driving roller and a third deflecting roller 66. Like the driving roller 12, the driving roller 65 is driven over the common drive strap 14 by the drive 15.

In this way, the laundry item 2' enters a minimum gap 68, which (as already explained above in connection with the transfer unit 20) springs back if the thickness of the textile 2' necessitates this. Herein, the spring tension in the transfer units 20, 60 is created by the tension of the straps 22 or 62. The transfer unit 60 is connected to an additional belt conveyor 70 with conveyor belts or straps 72 which rotate over a deflecting roller 73 and a driving roller 74, wherein the rollers 73, 74 are mounted in opposite side plates 75, 76. For tensioning the strap and for changing a conveying gap 77 between the deflecting roller 66 and the roller 74, the roller 74 can be mounted so as to be displaceable in the arrow direction 79 against the force of a spring 78 and the force of an opposite additional spring, not visible here.

In a similar way to that described above, the belt conveyor 70 and the second transfer unit 60 form a second modular conveyor unit 80 in that the above-described components 60, 70 are arranged integrally in a subassembly 81 and borne by the side plates 75, 76, such that they can be mounted as prefabricated modular assemblies that can be inspected in advance—as will be explained in more detail below—with additional modular conveyor units to the conveyor device according to the invention.

The laundry item (in FIG. 1, only indicated schematically and designated 2" for differentiation), which, in the course of the further transport, is trapped in the minimum gap 68, further transported over the strap 62 and finally deposited on a conveyor plane 86 of the belt conveyor 70, is first further transported in the arrow direction 79 toward the left. For further folding processes, not described in detail here, the drive of the belt conveyor 70 can be reversed so that, after a folding process, the laundry item 2" is conveyed back toward the right against the direction of the arrow 79 and hereby enters the conveying gap 77 formed between the straps 62 and 72. Hence, (as only indicated in FIG. 1), the laundry item arrives on an additional conveyor plane 92 of an additional belt conveyor 93. The conveyor plane 92 is formed by upper sides of rotating straps 94, which run over a deflecting roller 95 and a driving roller 96. For differentiation, in this position on the conveyor plane 92, the laundry item is designated 2''' and is conveyed in the arrow direction 97 toward the left in the direction of an additional transfer unit 98.

The transfer unit 98 has substantially the same design as the transfer units 20, 60, as, for example, described in detail in connection with the modular conveyor unit 80. The transfer unit 98 is connected to an additional belt conveyor 99, wherein the transfer unit 98 and the belt conveyor 99—like the components of the belt conveyor 70 and the second transfer unit 60 forming the modular conveyor unit 80—form a modular conveyor unit 100 in that they are implemented as integral components of a subassembly 101. The transfer unit 98 comprises straps 105, which run over a driving roller 107 (driven by a drive strap 106 that is only indicated in the drawing) and deflecting rollers 108, 109.

The straps 105 form with the straps 94 an additional drawing-in gap or minimum gap 110, which the laundry item 2''' enters on further conveyance. The laundry item then arrives at straps 112 of the additional belt conveyor 99. The straps run over a driving roller 116 and a deflecting roller 114. The belt conveyor 99 has a similar design to that of the belt conveyor 70 of the modular conveyor unit 80. When required, the conveying gap 118 between the roller 107 and the deflecting roller 114 can be enlarged against the force of a pair of springs (only one spring 119 is visible). In FIG. 1, the laundry item that has arrived on a conveyor plane 120 formed by the upper sides of the belts 112 in FIG. 1 is designated 2'''' for differentiation. When the laundry item 2'''' has been conveyed in the arrow direction 123 toward the right as far as is necessary for any additional folding processes, a reversal of the direction of the driving roller 116 can cause the laundry item to be transported back against the direction of the arrow 123 so that it becomes engaged by the straps 105 running around the roller 109 on the one hand and the straps 112 running around the roller 114 on the other hand and is thus discharged downward to an outfeed region 130. There, the fully folded laundry item 2'''' is deposited or removed.

As can be seen, in each case, a belt conveyor forms, together with in each case at least one transfer unit arranged integrally therewith in a respective subassembly in each case, a modular conveyor unit (50, 80, 100). Particularly preferably, the modular conveyor units (for example 80 and 100) can have approximately the same design.

As FIGS. 1 and 2 further show, the individual modular conveyor units 50, 80, 100 are arranged one atop the other and connected to one another preferably detachably (for example by means of screws). This is achieved using spacer elements 140 that can also include adjusting mechanisms not shown in further detail here so that the subassemblies or the modular conveyor units formed thereby can be aligned and positioned relative to one another.

Figure 3:
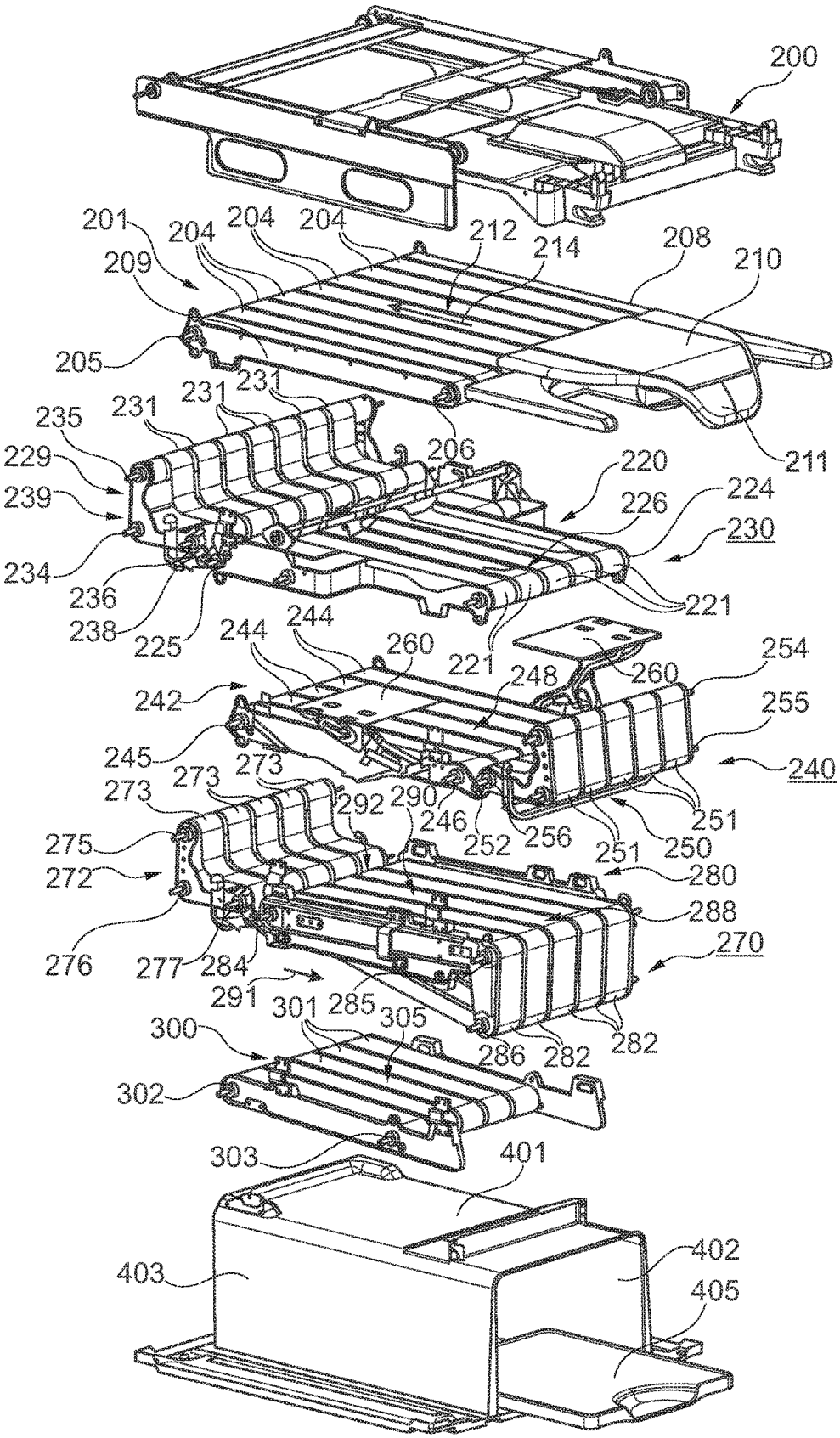
Figure 4:
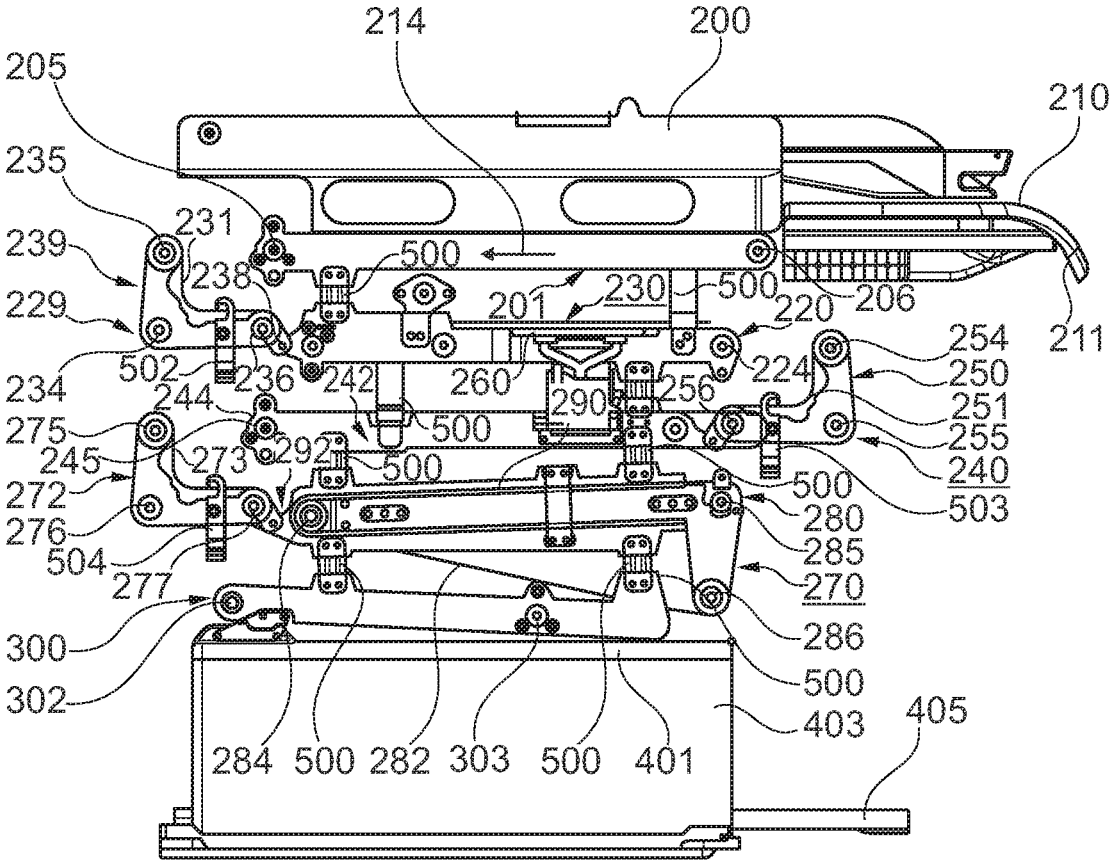

FIG. 3 shows an additional conveyor device according to the invention in an exploded view before the assembly of individual modular conveyor units. FIG. 4 shows a corresponding side view. Arranged below an upper termination 200, there is a first belt conveyor 201 with a plurality of straps 204 extending in the parallel and running around a deflecting roller 205. Together with a driving roller 206, the deflecting roller 205 is in each case mounted in side plates 208, 209. On the right, an infeed region 210 with an infeed aid 211 designed for shirts, for example, is provided. The upper sides of the straps 204 form a first conveyor plane 212 on which a laundry item (not shown here, but see FIG. 6 in this regard) arrives from the infeed region 210 and is transported in the arrow direction 214.

An additional belt conveyor 220 with straps 221 that rotate around a driving roller 224 and a deflecting roller 225 is provided in an underlying plane. The upper sides of the straps 221 form an additional conveyor plane 226 for a textile, not shown. The belt conveyor 220 and a transfer unit 229 are integral preassembled components of a conveyor unit 230 with a modular design. The transfer unit 229 includes a plurality of straps 231 that rotate over deflecting rollers 234, 235 and a driving roller 236 driven by a drive, not depicted. The transfer unit 229 is mounted pivotably about a pivot axis 238 formed by coupling points relative to the belt conveyor 220. In FIG. 3, the transfer unit 229 is shown in pivoted position (service position) 239.

An additional modular conveyor unit 240 is arranged below the modular conveyor unit 230. This also comprises an additional belt conveyor 242 with a plurality of straps 244 running in parallel that run over a driving roller 245 and a deflecting roller 246 and form a conveyor plane 248 on their upper sides. Arranged opposite the roller 246, there is an additional transfer unit 250 with a plurality of rotating straps 251 and coupled pivotably about a pivot axis 252 as an integral component of the modular conveyor unit 240. As already explained in principle, the straps 251 run over deflecting rollers 254, 255 and 256 of which at least one is driven. Parts 260 of a bilaterally arranged folding mechanism to which a (not shown here) textile can be conveyed on the overlying conveyor plane 226 are only indicated.

An additional conveyor unit 270 in the above-described modular design is arranged below the conveyor unit 240. This can have the same or a similar design as the above-described conveyor units 230 and 240 so that a multiplicity of the same elements can be used. The modular conveyor unit 270 includes a transfer unit 272 with the same design as the above-described transfer units and pivotably coupled with straps 273 that rotate over deflecting rollers 275, 276 and 277 of which at least one roller is driven. This is connected to an additional belt conveyor 280 with conveyor belts or straps 282 running in parallel that run over deflecting rollers 284, 285 and 286 of which at least one roller can be driven. The straps 282 form a conveyor plane 290 on their upper side 288. A textile located on the conveyor plane 290 is first conveyed in the arrow direction 291 in order then, by reversal of the drive and hence reversal of the conveying direction of the straps 282 against the arrow direction 291, to effect a folding or shaping of the textile and the conveyance thereof through a gap 292 formed between the straps 273 rotating around the deflecting roller 277 on the one hand and the straps rotating around the deflecting roller 284 on the other hand.

Finally, an additional belt conveyor 300 is provided with straps 301 running in parallel and rotating over deflecting rollers 302 and 303 which pick up textiles conveyed through the gap 292 on the conveyor plane 305 formed by the upper sides of the straps 301 in order to optionally subject this to further folding or a depositing process. The fully folded textile passes through a deposition opening 401 into a receiving area 402 of a storage box 403 that forms an outfeed region 405 for the folded textile.

As FIG. 4 shows, the individual modular conveyor units 230, 240 and 270, described above in detail, are mounted vertically one atop the other and aligned. For this purpose, the individual subassemblies are connected detachably to one another by assembly or fastening elements 500 so that the modular conveying units are so-to-speak in a stack arrangement one atop the other. Thus, when dismantling or repair work is necessary, it is easy to separate individual or multiple modular conveyor units from one another, wherein for the maintenance and/or repair work, the transfer units can be pivoted into a service position, such as depicted in FIG. 4 (in FIG. 4 by way of example only the service position 239 of the transfer unit 229 is explicitly provided with a reference character). In order to swing the transfer units 229, 250 and 272 into their respective service position, beforehand interlocking elements 502, 503, 504 that would otherwise hold the transfer units in their respective operating position (see FIG. 5) are released (unlocked).

Figure 5:
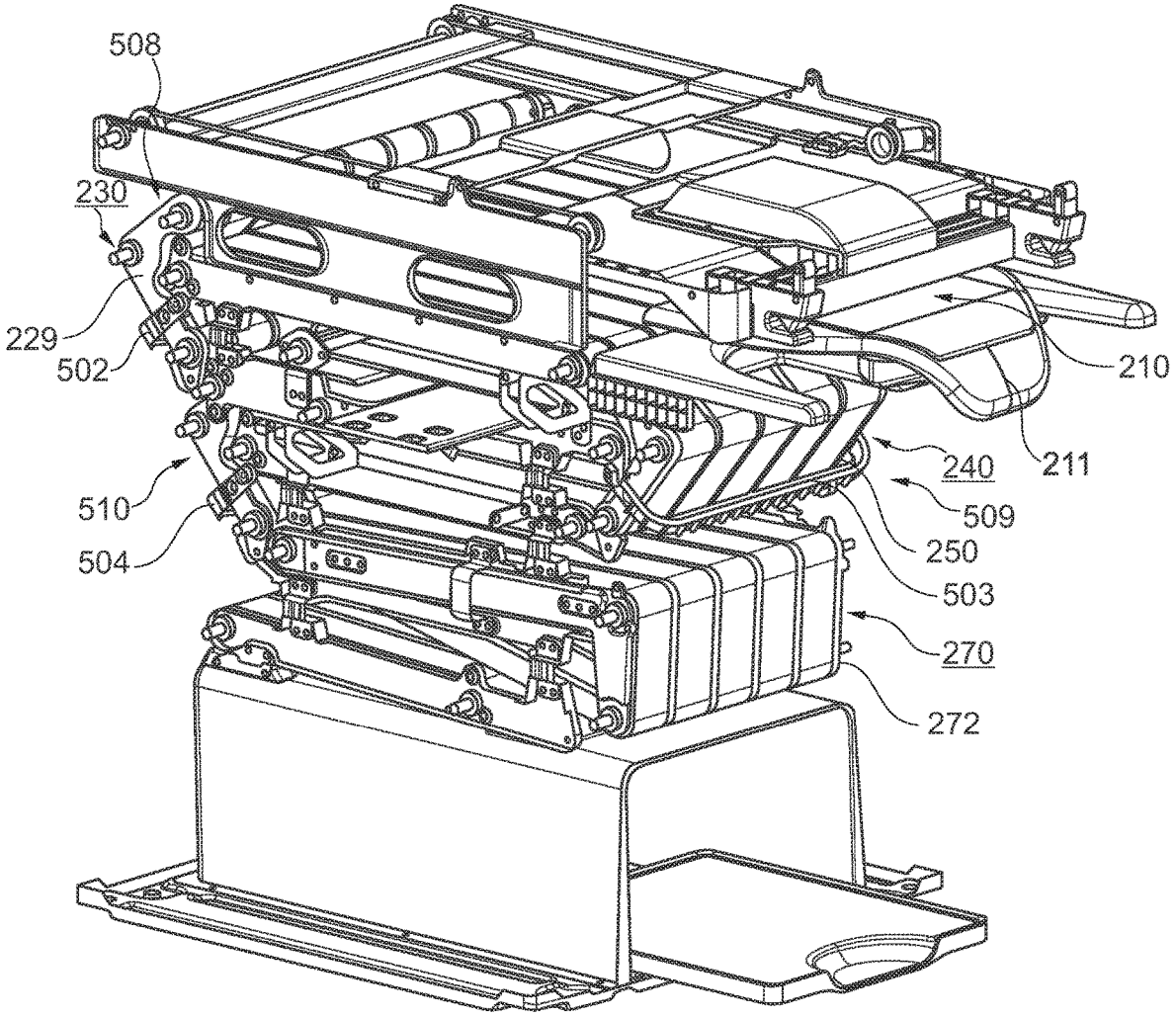

FIG. 5 is a perspective view of the exemplary embodiment of a conveyor device according to the invention shown in FIGS. 3 and 4 in assembled state. The transfer units 229, 250 and 272 are located in their respective operating position 508, 509, 510. The interlocking elements 502, 503, 504 are in interlocked state in that recesses of the respective interlocking elements engage behind interlocking pins. Herein, the interlockings can have play so that the transfer units can be easily sprung open against the spring tension created by the respective impinging straps in order to allow the passage of textiles with a greater thickness (as described in connection with FIGS. 1 and 2).

Figure 6:
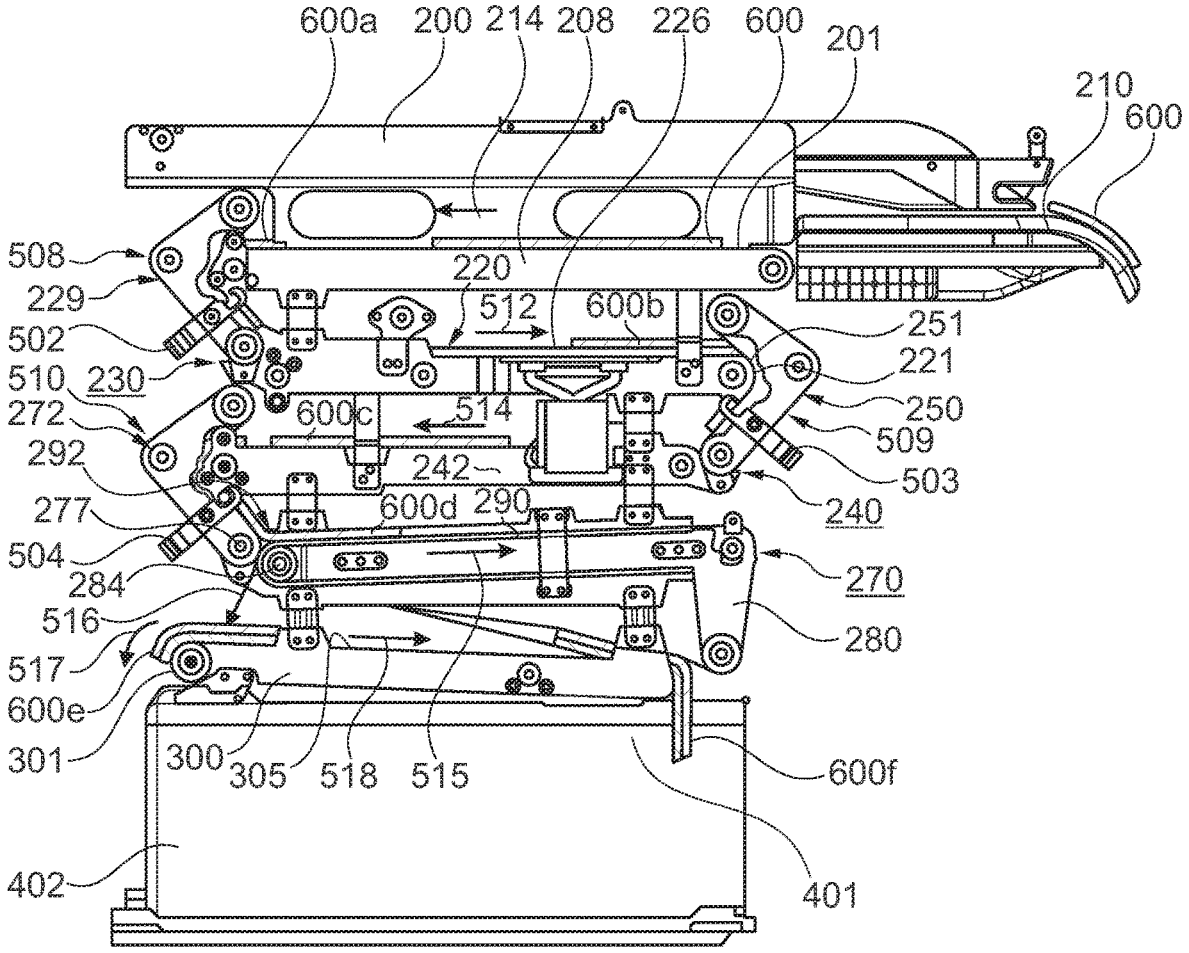

FIG. 6 shows the exemplary embodiment according to FIGS. 3 to 5 in side view; in this regard, reference is also made to the above description with respect to details. In the depiction shown in FIG. 6, the transfer units 229, 250 and 272 are swung into their respective operating position 508, 509, 510 and locked into these positions by means of the interlocking elements 502, 503, 504. FIG. 6 is a schematic illustration of different phases of the conveyance of a textile 600 through the conveyor device according to the invention. When the textile 600 has been fed in over the infeed region 210 and collected by the belt conveyor 201 and transported in the arrow direction 214, the textile 600 enters the drawing-in region of the transfer unit 229 of the modular conveyor unit 230. In this position, the textile is designated 600*a*. The textile 600*a* then arrives at the conveyor plane 226 of the belt conveyor 220 of the conveyor unit 230 and is conveyed in the arrow direction 512 toward the right as far as the transfer unit 250. There, the textile arrives between the straps 221 and 251 in which position it is designated 600*b*. From the belt conveyor 242 of the conveyor unit 240, the textile is further conveyed in the arrow direction 514 until it arrives at the transfer unit 272 of the modular conveyor unit 270. In this position, the textile is designated 600*c*. The textile is further transported to be picked up by the transfer unit 272 and transferred thereby for deposition on the conveyor plane 290 of the belt conveyor 280; there the textile is designated 600*d*. It can then be conveyed in the arrow direction 515 toward the right until a desired folding region of the textile passes through the gap 292 present between the deflecting roller 277 of the transfer unit 272 one the one hand and the deflecting roller 284 on the other hand. Subsequent reversal of the drive of the belt conveyor 280 causes the textile to be conveyed against the arrow direction 515 and to arrive in the gap 292 so that, folded in the arrow direction 516 in the configuration designated 600*e* in the FIG. 6, it arrives at the conveyor plane 305 of the belt conveyor 300 and is first moved in the arrow direction 517. Then, there can be an additional conveyance in the arrow direction 518 until the textile (designated 600*f* in this position) passes through the deposition opening 401 and enters the storage space 402 or the outfeed region 405.

REFERENCE CHARACTERS

1 Infeed or feed region
2 Textile (laundry item)
2' Textile (laundry item)
2" Textile (laundry item)
2'" Textile (laundry item)
2"" Textile (laundry item)
3 First belt conveyor
4 Conveyor strap
5 Arrow direction
6 Deflecting roller
8 First conveyor plane
9 Plane
12 Driving roller
14 Drive strap
15 Drive
16 Side part
18 Side part
20 First transfer unit
22 Conveyor strap
24 First deflecting roller
25 Additional deflecting roller
26 Driving roller
27 Side plate
28 Side plate
30 Lever
31 Lever
32 Pivot point
33 Pivot point
34 Operating position
37 Interlocking element
38 Interlocking element
40 Drive direction
42 Region
43 Minimum gap
45 Conveyor plane
46 Plane
48 Belt conveyor
49 Subassembly
50 First modular conveyor unit
52 Arrow direction
54 Arrow direction
56 Drawing-in region
60 Transfer unit
62 Strap
64 Deflecting roller
65 Driving roller
66 Deflecting roller
68 Minimum gap
70 Belt conveyor
72 Belt
73 Deflecting roller
74 Driving roller
75 Side plate
76 Side plate
77 Conveying gap
78 Spring
79 Arrow direction
80 Second modular conveyor unit
81 Second subassembly
86 Conveyor plane
92 conveyor plane
93 Belt conveyor

94 Strap
95 Deflecting roller
96 Driving roller
97 Arrow direction
98 Transfer unit
99 Additional belt conveyor
100 Modular conveyor unit
101 Subassembly
105 Strap
106 Drive strap
107 Driving roller
108 Deflecting roller
109 Deflecting roller
110 Minimum gap
112 Conveyor strap
114 Deflecting roller
116 Driving roller
118 Conveying gap
119 Spring
120 Conveyor plane
123 Arrow direction
130 Outfeed region
140 Spacer elements
200 Termination
201 Belt conveyor
204 Strap
205 Deflecting roller
206 Driving roller
208 Side plate
209 Side plate
210 Infeed region
211 Infeed aid
212 Conveyor plane
214 Arrow direction
220 Belt conveyor
221 Strap
224 Driving roller
225 Deflecting roller
226 Conveyor plane
229 Transfer unit
230 Conveyor unit
231 Strap
234 Deflecting roller
235 Deflecting roller
236 Driving roller
238 Pivot axis
239 Service position
240 Conveyor unit
242 Belt conveyor
244 Strap
245 Driving roller
246 Deflecting roller
248 Conveyor plane
250 Transfer unit
251 Strap
252 Pivot axis
254 Deflecting roller
255 Deflecting roller
256 Deflecting roller
260 Parts
270 Conveyor unit
272 Transfer unit
273 Strap
275 Deflecting roller
276 Deflecting roller
277 Deflecting roller
280 Belt conveyor
282 Strap
284 Deflecting roller
285 Deflecting roller
286 Deflecting roller
288 Upper side
290 Conveyor plane
291 Arrow direction
292 Gap
300 Belt conveyor
301 Strap
302 Deflecting roller
303 Deflecting roller
305 Conveyor plane
401 Deposition opening
402 Storage area
403 Storage box
405 Outfeed region
500 Fastening elements
502 Interlocking element
503 Interlocking element
504 Interlocking element
508 Operating position
509 Operating position
510 Operating position
512 Arrow direction
514 Arrow direction
515 Arrow direction
516 Arrow direction
517 Arrow direction
518 Arrow direction
600 Textile
600*a* Textile
600*b* Textile
600*c* Textile
600*d* Textile
600*e* Textile
600*f* Textile

The invention claimed is:

1. A conveyor device for a folding apparatus for folding textiles, the conveyor device comprising:

an infeed region for a textile and an outfeed region for a folded textile;

a first transferer;

a first belt conveyor defining a first conveyor plane and a second belt conveyor defining a second conveyor plane;

said first belt conveyor conveying the textile on said first conveyor plane from said infeed region to said first transferer and said first transferer feeding the textile to said second conveyor plane of said second belt conveyor;

at least one second transferer and at least one additional belt conveyor defining an additional conveyor plane, said at least one second transferer and said at least one additional belt conveyor being disposed downstream of said second belt conveyor;

at least two subassemblies each configured as modular conveyor units, one of said belt conveyors and at least one of said transferers being integrated into each respective one of said at least two subassemblies; and said at least two subassemblies forming a plurality of modular conveyor units disposed atop one another, connected to one another and providing the conveyor device with a modular configuration.

2. The conveyor device according to claim 1, which further comprises at least one drive strap driving a plurality of said belt conveyors in common.

3. The conveyor device according to claim 1, wherein said at least one transferer of at least one of said modular conveyor units is pivotable relative to said at least one modular conveyor unit from an operating position into a service position.

4. The conveyor device according to claim 3, wherein said at least one transferer is under spring tension in said operating position.

5. The conveyor device according to claim 4, wherein each respective transferer includes one or more straps applying the spring tension.

6. The conveyor device according to claim 4, wherein one of said transferers and a corresponding belt conveyor form a gap therebetween, said gap widening in dependence on a thickness of a conveyed textile.

* * * * *